US010166651B2

(12) United States Patent
Tian et al.

(10) Patent No.: US 10,166,651 B2
(45) Date of Patent: Jan. 1, 2019

(54) VIBRATORY FINISHING APPARATUS, FIXTURES AND METHOD

(71) Applicant: ROLLS-ROYCE plc, London (GB)

(72) Inventors: Yebing Tian, Singapore (SG); Chow Cher Wong, Singapore (SG); Wallace Ong, Singapore (SG); Chao Yen Liew, Singapore (SG); Luke Robinson, Lancashire (GB)

(73) Assignee: ROLLS-ROYCE plc, London (GB)

( * ) Notice: Subject to any disclaimer, the term of this patent is extended or adjusted under 35 U.S.C. 154(b) by 37 days.

(21) Appl. No.: 15/151,085

(22) Filed: May 10, 2016

(65) Prior Publication Data

US 2016/0346896 A1 Dec. 1, 2016

(30) Foreign Application Priority Data

May 29, 2015 (GB) ..... 1509230.7

(51) Int. Cl.
*B24B 37/20* (2012.01)
*B24B 31/06* (2006.01)
*B24B 31/00* (2006.01)

(52) U.S. Cl.
CPC ..... *B24B 37/20* (2013.01); *B24B 31/003* (2013.01); *B24B 31/06* (2013.01); *B24B 31/064* (2013.01)

(58) Field of Classification Search
CPC ... B24B 31/003; B24B 31/0212; B24B 31/06; B24B 31/064; B24B 31/10
USPC ..... 451/32, 35, 326, 328, 329
See application file for complete search history.

(56) References Cited

U.S. PATENT DOCUMENTS 4,706,414 A 11/1987 Muzik
5,226,969 A * 7/1993 Watanabe ..... B08B 3/06 134/105
5,375,377 A * 12/1994 Kenton ..... B24B 31/16 451/22
5,460,566 A * 10/1995 Trahan ..... B24B 31/06 451/104
5,512,008 A * 4/1996 Musschoot ..... B24B 31/06 451/328
5,593,339 A 1/1997 Yam et al.
6,261,154 B1 * 7/2001 McEneny ..... B24B 29/02 451/32
7,883,396 B2 * 2/2011 Potterfield ..... B24B 31/073 451/326

(Continued)

FOREIGN PATENT DOCUMENTS

CN 1075274 A 8/1993
DE 1931824 U 1/1966

(Continued)

OTHER PUBLICATIONS

Oct. 28, 2015 Search Report issued in British Patent Application No. GB1509230.7.

(Continued)

*Primary Examiner* — Eileen Morgan
(74) *Attorney, Agent, or Firm* — Oliff PLC

(57) ABSTRACT

Vibratory finishing apparatus comprising: a receptacle to receive media; a first fixture to: support an object within the receptacle; and move the object relative to the receptacle in at least a first direction; and a first guide to move relative to the receptacle to direct movement of the media within the receptacle to a predetermined part of the object.

17 Claims, 8 Drawing Sheets

(56) References Cited

U.S. PATENT DOCUMENTS

| | | | | |
|---|---|---|---|---|
| 2001/0003696 | A1* | 6/2001 | Kawasaki | B24B 1/00 451/34 |
| 2001/0007811 | A1* | 7/2001 | Kawasaki | B24B 31/003 451/104 |
| 2002/0077047 | A1* | 6/2002 | Kawasaki | B24B 1/00 451/326 |
| 2003/0216110 | A1* | 11/2003 | Bohm | B24B 31/003 451/36 |
| 2005/0136802 | A1 | 6/2005 | Rudiger | |
| 2006/0246825 | A1 | 11/2006 | Bolz et al. | |
| 2011/0117820 | A1* | 5/2011 | Sroka | B24B 31/003 451/36 |
| 2014/0065929 | A1* | 3/2014 | Davidson | B24B 31/073 451/32 |
| 2014/0227944 | A1* | 8/2014 | van Kleef | B24B 1/00 451/36 |
| 2014/0235146 | A1* | 8/2014 | Mingot | B24B 31/064 451/392 |
| 2014/0273757 | A1* | 9/2014 | Beckman | B24B 31/003 451/36 |
| 2016/0176008 | A1* | 6/2016 | Maeda | B24B 31/02 451/32 |
| 2016/0184959 | A1* | 6/2016 | Martin | B24B 31/003 451/29 |
| 2016/0229022 | A1* | 8/2016 | Bianchi | B24B 19/14 |

FOREIGN PATENT DOCUMENTS

| | | | |
|---|---|---|---|
| DE | 2919401 | A1 | 2/1981 |
| DE | 102013107497 | A1 | 1/2015 |
| EP | 1362669 | A2 | 11/2003 |
| EP | 2329916 | A1 | 6/2011 |
| JP | 2009-125862 | A | 6/2009 |
| RU | 2030281 | C1 | 3/1995 |
| SU | 1404296 | A1 | 6/1988 |
| SU | 1407770 | A1 | 7/1988 |

OTHER PUBLICATIONS

Sep. 26, 2016 Search Report issued in European Patent Application No. 16168900.

E. Uhlmann et al. "Polieren Komplexer Bauteile". Werkstall + Betrieb, Carl Hanser Verlag, München DE, vol. 144, No. 6, Jun. 1, 2011, pp. 28-31.

* cited by examiner

VIBRATORY FINISHING APPARATUS, FIXTURES AND METHOD

TECHNOLOGICAL FIELD

The present disclosure concerns vibratory finishing apparatus, fixtures and methods of treating objects.

BACKGROUND

Vibratory finishing apparatus usually include a receptacle filled with abrasive media, and motors for vibrating the receptacle and thereby moving the abrasive media within the receptacle. For example, the vibratory finishing apparatus may include a bowl vibrator or a trough vibrator having a vibration generator (such as one or more motors located at the bottom or side of the receptacle for driving rotating shafts with eccentric weights).

In operation, an object to be treated (such as a fan blade of a gas turbine engine) is placed within the receptacle so that it is at least partly immersed within the abrasive media. For example, only the root of a fan blade may be immersed within the abrasive media. The receptacle is then vibrated by the motor so that the abrasive media moves within the receptacle and rubs against the object and removes a surface layer of material from the object.

BRIEF SUMMARY

According to various, but not necessarily all, embodiments there is provided vibratory finishing apparatus comprising: a receptacle to receive abrasive media; a first fixture to: support an object within the receptacle; and move the object relative to the receptacle in at least a first direction; and a first guide to move relative to the receptacle to direct movement of the media within the receptacle to a predetermined part of the object.

The first fixture may be arranged to move the object relative to the receptacle in at least the first direction by rotating the object. The first guide may be arranged to move relative to the receptacle by rotating relative to the receptacle.

The first fixture may be arranged to move the object relative to the receptacle in a second direction, different to the first direction.

The first fixture may be arranged to move the object relative to the receptacle in the second direction by rotating the object.

The first fixture may comprise a first fastener to fasten the first fixture to the receptacle.

The first fixture may comprise a second fastener to fasten the object to the first fixture.

The Vibratory finishing apparatus may further comprise a first divider to be positioned within the receptacle. The first divider may comprise a fastener to fasten the first divider to the receptacle.

The first guide may be connected at least to the first divider and may be arranged to rotate relative to the first divider.

The first guide may be connected to the receptacle.

The first guide may be configured to be static relative to the receptacle while directing movement of the media within the receptacle to the predetermined part of the object. The first guide may be configured to not rotate relative to the receptacle while directing movement of the media within the receptacle to the predetermined part of the object.

The vibratory finishing apparatus may further comprise: a second fixture to: support a further object within the receptacle; and move the further object relative to the receptacle in at least a first direction; and a second guide to move relative to the receptacle to direct movement of the media within the receptacle to a predetermined part of the further object.

The second guide may be configured to be static relative to the receptacle while directing movement of the media within the receptacle to the predetermined part of the further object. The second guide may be configured to not rotate relative to the receptacle while directing movement of the media within the receptacle to the predetermined part of the further object.

The object may comprise a fan blade root, or a nozzle guide vane, or a component manufactured by three dimensional additive manufacturing.

According to various, but not necessarily all, embodiments of the invention there is provided a fixture comprising: a first fastener to fasten the fixture to a receptacle of a vibratory finishing apparatus; a second fastener to fasten an object to the fixture; and a first joint to enable the object to be moved relative to the receptacle in at least a first direction.

The fixture may further comprise a second joint to enable the object to be moved relative to the receptacle in a second direction, different to the first direction.

According to various, but not necessarily all, embodiments of the invention there is provided a method of treating an object, the method comprising: providing vibratory finishing apparatus as described in any of the preceding paragraphs;

coupling an object to the first fixture of the vibratory finishing apparatus; moving at least one of the first fixture and the first guide relative to the receptacle; providing abrasive media to the receptacle of the vibratory finishing apparatus; and activating a vibration generator of the vibratory finishing apparatus to vibrate the receptacle and cause the abrasive media to rub against the object.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION

Embodiments will now be described by way of example only, with reference to the Figures, in which.

DETAILED DESCRIPTION

In the following description, the terms 'connected' and 'coupled' mean operationally connected and coupled. It should be appreciated that there may be any number of intervening components between the mentioned features, including no intervening components.

Figure 1:
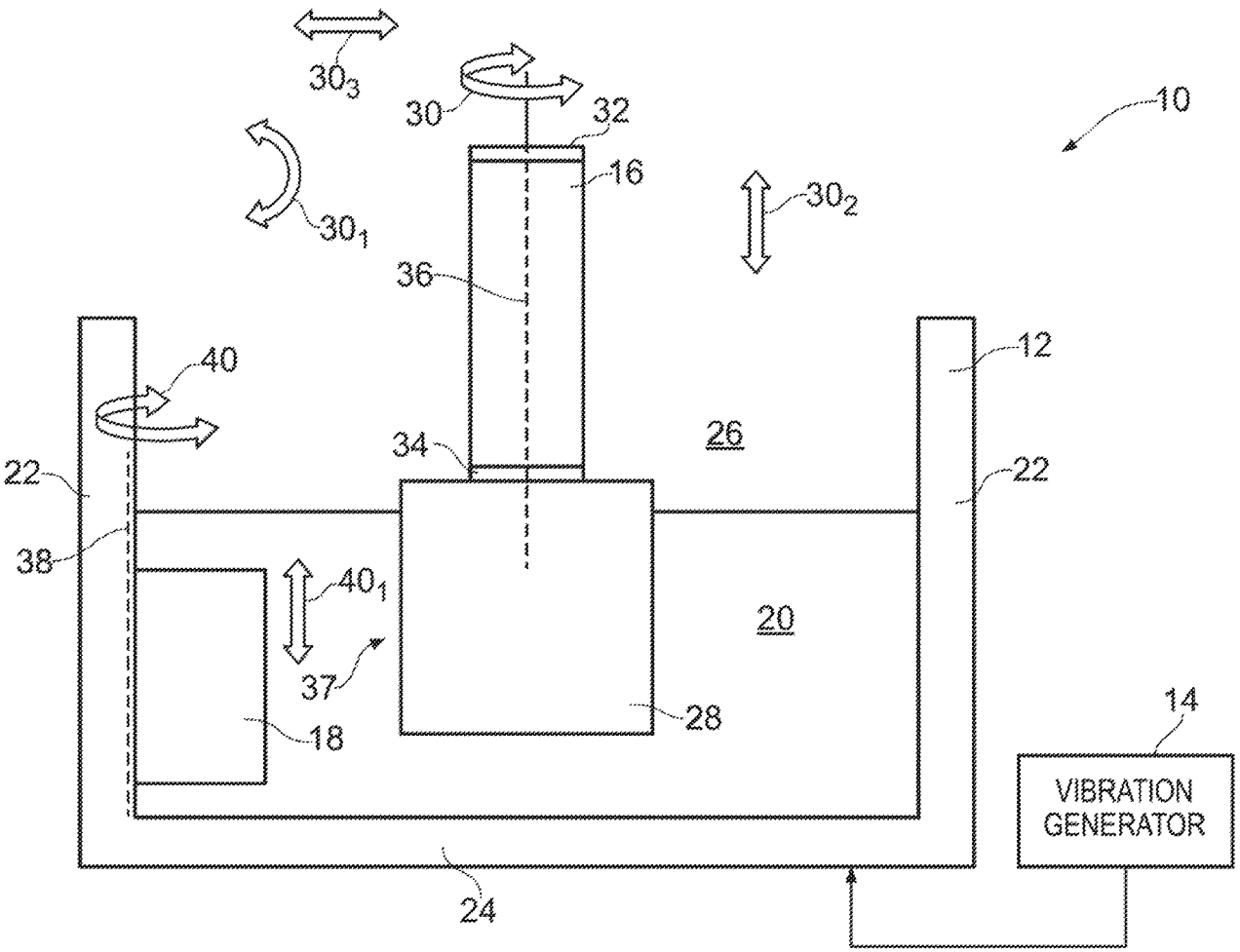
FIG. 1 illustrates a schematic cross sectional side view of vibratory finishing apparatus according to various examples.
Figure 2:
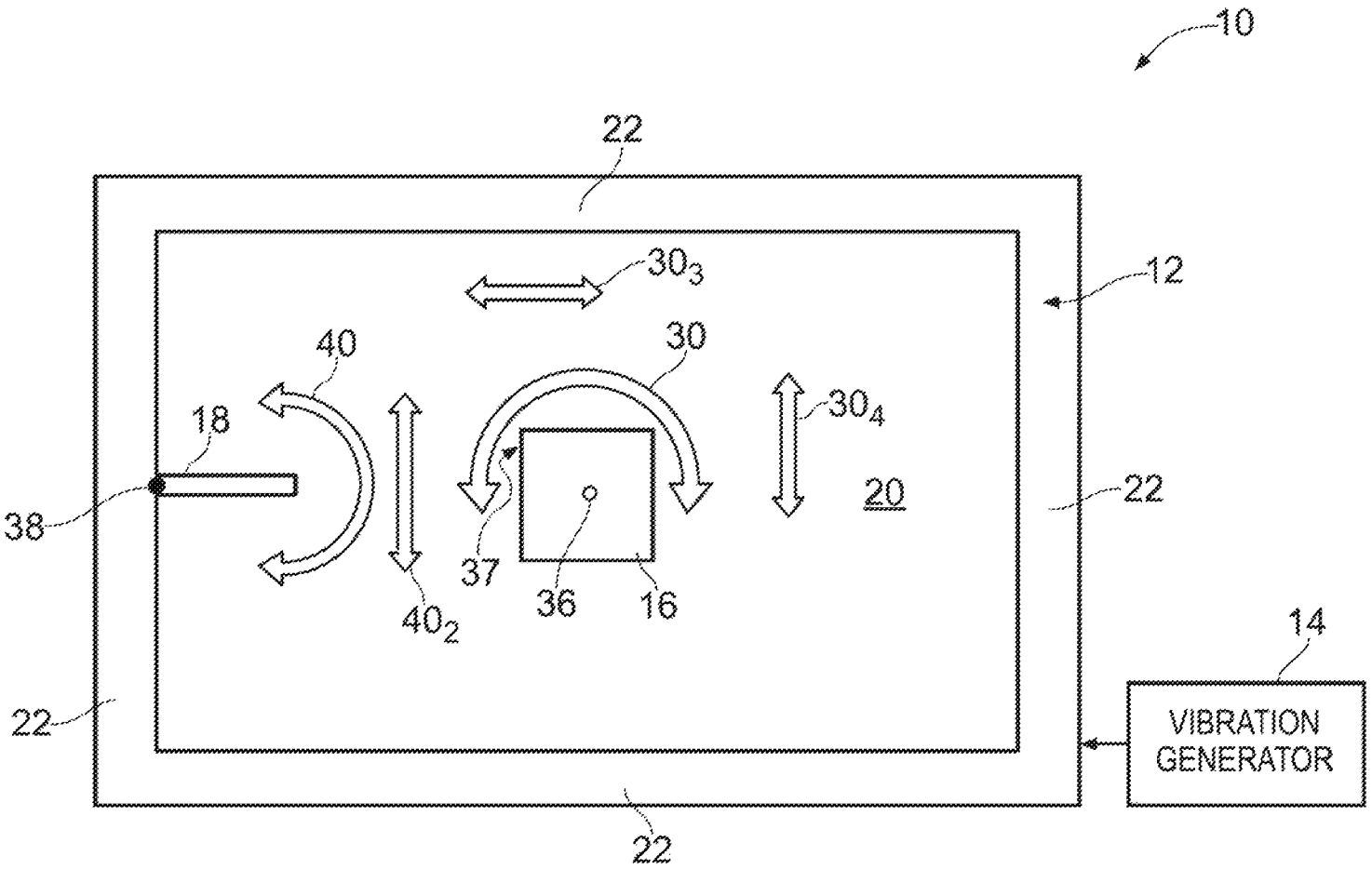
FIG. 2 illustrates a schematic plan view of the vibratory finishing apparatus illustrated in FIG. 1.

In more detail, FIGS. 1 and 2 illustrate vibratory finishing apparatus 10 including a receptacle 12, at least one vibration generator 14, a fixture 16 and a guide 18. In some examples, the vibratory finishing apparatus 10 may be a module. As used herein, the wording 'module' refers to a device or apparatus where one or more features are included at a later time, and possibly, by another manufacturer or by an end user. For example, where the vibratory finishing apparatus 10 is a module, the vibratory finishing apparatus 10 may only include the receptacle 12, the fixture 16 and the guide 18, and the remaining features (such as the vibration generator 14) may be added by another manufacturer, or by an end user.

The receptacle 12 may have any suitable shape and may have any suitable dimensions. For example, the receptacle 12 may have a bowl shape or a trough shape. The receptacle 12 includes side walls 22 and a base 24 that define a cavity 26 for receiving and containing the abrasive media 20. The abrasive media 20 may comprise any suitable abrasive media and may comprise ceramic particles and/or metal particles.

The one or more vibration generators (such as one or more motors 14 for driving rotating shafts with eccentric weights) are arranged to vibrate the receptacle 12 and thereby cause movement of the abrasive media 20 relative to the receptacle 12. The one or more vibration generators 14 may be positioned at any suitable location, and may be positioned underneath the receptacle 12 (in other words, the one or more vibration generators 14 may be positioned adjacent the base 24 of the receptacle 12) or to the side of the receptacle 12.

The fixture 16 is arranged to support an object 28 within the receptacle 12. The fixture 16 may extend into the cavity 26 defined by the receptacle 12 or may be positioned outside and above the cavity 26. Furthermore, the fixture 16 may partially or wholly immerse the object 28 within the abrasive media 20. The fixture 16 may include a first fastener 32 for fastening the fixture 16 to the receptacle 12 or for fastening the fixture 16 to another body (which may or may not be part of the vibratory finishing apparatus 10). The fixture 16 may also include a second fastener 34 for fastening the fixture 16 to the object 28.

The fixture 16 is arranged to move the object 28 relative to the receptacle 12 in at least a first direction 30. For example, the fixture 16 may have a longitudinal axis 36 that is parallel to the side walls 22 and perpendicular to the base 24 of the receptacle 12. The fixture 16 may be arranged to rotate (that is, roll) about the longitudinal axis 36 in a clockwise direction 30 and in an anti-clockwise direction 30 to rotate the object 28 relative to the receptacle 12 (that is, rotation in the azimuthal direction where the longitudinal axis 36 is the longitudinal axis of a cylindrical coordinate system). In other examples, the fixture 16 may be additionally or alternatively arranged to rotate (as indicated by arrow $\mathbf{30}_1$) to change the pitch of the object 28 relative to the receptacle 12. In further examples, the fixture 16 may additionally or alternatively be arranged to move laterally (as indicated by arrows $\mathbf{30}_2$, $\mathbf{30}_3$ and $\mathbf{30}_4$) relative to the receptacle 12.

It should be appreciated that the object 28 may be any product, apparatus, device, part or component. For example, the object 28 may include a fan blade root or a nozzle guide vane of a gas turbine engine. By way of another example, the object 28 may be a component manufactured by three dimensional additive manufacturing.

The guide 18 is arranged to move relative to the receptacle 12 to direct movement of the media 20 within the receptacle 12 to a predetermined part 37 of the object 28. In more detail, the guide 18 may be configured to be static (or at least not rotate) relative to the receptacle 12 while directing movement of the media within the receptacle to the predetermined part 37.

For example, the guide 18 may be rotated to an orientation to direct the movement of the media 20 within the receptacle 12 to a tarnish layer on a fan blade root and a shear key slot on a fan blade of a gas turbine engine. The guide 18 may be connected to the receptacle 12 (for example, one of the side walls 22 as illustrated in FIGS. 1 and 2) and arranged to rotate about an axis 38 that is parallel to the side walls 22 (as indicated by arrow 40) (that is, rotation in the azimuthal direction where the axis 38 is the longitudinal axis of a cylindrical coordinate system). In other examples, the guide 18 may additionally or alternatively be moved laterally relative to the receptacle 12 as indicated by arrows $\mathbf{40}_1$ and $\mathbf{40}_2$.

Where it is desired to treat a predetermined part (such as part 37) of the object 28, the fixture 16 may be moved so that the predetermined part 37 faces the guide 18. Then, the guide 18 may be moved so that the guide 18 is oriented towards the predetermined part 37 and so that abrasive media 20 is directed towards the predetermined part 37 by the guide 18. It should be appreciated that in other examples, the guide 18 may first be moved into a desired position, and the fixture 16 may then be moved so that the predetermined part 37 is treated by the abrasive media 20.

The vibratory finishing apparatus 10 may provide several advantages. First, the fixture 16 and the guide 18 may be moved so that abrasive media 20 is directed towards, and rubs against, a predetermined part of the object 28. This may advantageously enable the vibratory finishing apparatus 10 to treat areas on the object 28 where conventional techniques (such as shot peening) are unable to access. Second, the fixture 16 and the guide 18 may be relatively low cost and may be used with an existing receptacle 12 (in other words, the fixture 16 and the guide 18 may be used with existing 'off the shelf' receptacles). Third, the fixture 16 and the guide 18 may be moved manually by hand and consequently, no robotics or programming skill may be required to operate the vibratory finishing apparatus 10. Fourth, since the fixture 16 and the guide 18 are adjustable, the vibratory finishing apparatus 10 may be set up for treating various surface areas of various different objects 28 (for example, objects 28 having different shapes and sizes).

Figure 3:
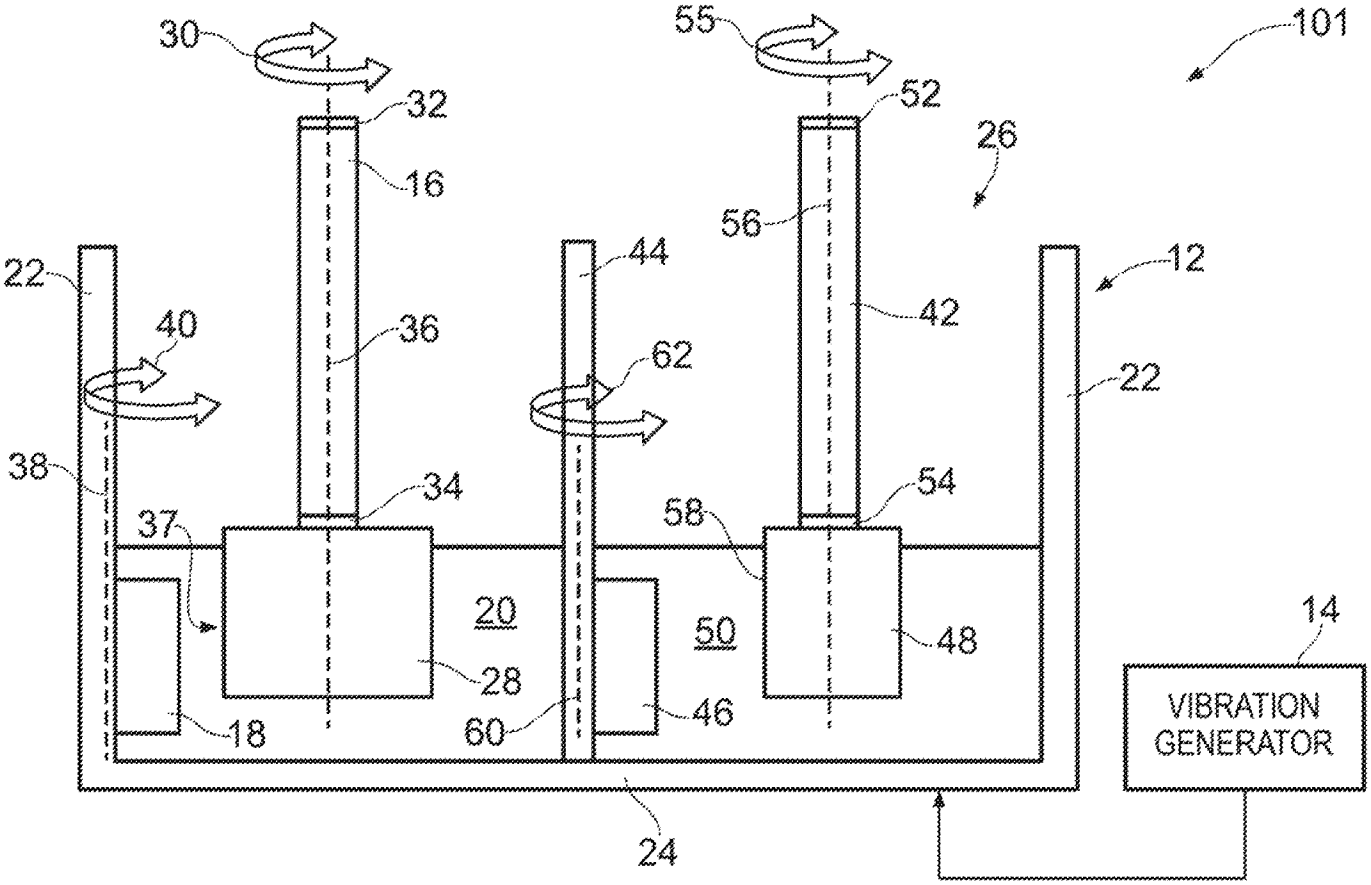
FIG. 3 illustrates a schematic cross sectional side view of another vibratory finishing apparatus according to various examples.

FIG. 3 illustrates a schematic cross sectional side view of another vibratory finishing apparatus 101 according to various examples. The vibratory finishing apparatus 101 is similar to the vibratory finishing apparatus 10 and where the features are similar, the same reference numerals are used. The vibratory finishing apparatus 101 includes a receptacle 12, at least one vibration generator 14, a first fixture 16, a first guide 18, a second fixture 42, a divider 44, and a second guide 46.

The first fixture 16 and the first guide 18 are arranged as described in the preceding paragraphs with reference to FIGS. 1 and 2 to enable the object 28 to be treated by the abrasive media 20.

The second fixture 42 is arranged to support an object 48 within the receptacle 12. The second fixture 42 may extend into the cavity 26 defined by the receptacle 12 or may be positioned outside and above the cavity 26.

Furthermore, the second fixture 42 may partially or wholly immerse the object 48 within the abrasive media 50. The second fixture 42 may include a first fastener 52 for fastening the second fixture 42 to the receptacle 12 or for fastening the second fixture 42 to another body (which may or may not be part of the vibratory finishing apparatus 101). The second fixture 42 may also include a second fastener 54 for fastening the second fixture 42 to the object 48.

The second fixture 42 is arranged to move the object 48 relative to the receptacle 12 in at least the first direction 55. For example, the second fixture 42 may have a longitudinal axis 56 that is parallel to the side walls 22 and perpendicular to the base 24 of the receptacle 12. The second fixture 42 may be arranged to rotate about the longitudinal axis 56 in a clockwise direction 30 and in an anti-clockwise direction 30 to rotate the object 48 relative to the receptacle 12. Additionally or alternatively, the second fixture 42 may be arranged to move laterally relative to the receptacle 12 (arrows are not illustrated in FIG. 3 to maintain the clarity of the Figure).

The object 48 may be any product, apparatus, device, part or component. For example, the object 48 may include a fan blade root or a nozzle guide vane of a gas turbine engine. By way of another example, the object 48 may be a component manufactured by three dimensional additive manufacturing. The object 48 may be the same type of object as the object 28, or may be a different type of object (for example, the object 28 may be a fan blade root, and the object 48 may be a nozzle guide vane).

The divider 44 is positioned within the cavity 26 defined by the receptacle 12 and between the first fixture 16 and the second fixture 42. The divider 44 may be sized and shaped so that it fits snugly within the cavity 26 and abuts the side walls 22 and the base 24 of the receptacle 12. The divider 44 may therefore be arranged to separate the abrasive media 20 and the abrasive media 50 from one another so that there is little to no flow of the abrasive media 20 into the abrasive media 50, and similarly, so that there is little to no flow of the abrasive media 50 into the abrasive media 20.

The divider 44 may be separate from the receptacle 12 and may be inserted into, and removed from, the receptacle 12. The divider 44 may include one or more fasteners for coupling the divider 44 to the receptacle 12 (or to another body, which may or may not be part of the vibratory finishing apparatus 101). In other examples, the divider 44 may be integral with the receptacle 12 and may not be removable from the receptacle 12 (for example, the divider 44 and the receptacle 12 may be coupled to one another at a welded or brazed joint).

The abrasive media 50 may be any suitable media and may, for example, include ceramic particles and/or metal particles. The abrasive media 50 may comprise the same media as the abrasive media 20, or may comprise a different media to the abrasive media 20.

The second guide 46 is coupled to the divider 44 and is arranged to extend towards the second fixture 42 (and therefore into the media 50). The second guide 46 is arranged to move about an axis 60 (as indicated by arrow 62) and move relative to the receptacle 12 and to the divider 44 to direct movement of the media 50 within the receptacle 12 to a predetermined part 58 of the object 48. In more detail, the second guide 46 may be configured to be static (or at least not rotate) relative to the receptacle 12 while directing movement of the media within the receptacle 12 to the predetermined part 58 of the further object 48.

For example, the second guide 46 may be rotated to direct the movement of the media 50 within the receptacle 12 to milling marks on a nozzle guide vane or milling marks on a runner casting. In other examples, the second guide 46 may be connected to the receptacle 12 (for example, one of the side walls 22 that contains the abrasive media 50). In some examples, the second guide 46 may additionally or alternatively be arranged to move laterally relative to the receptacle 12 (arrows are not illustrated in FIG. 3 to maintain the clarity of the Figure).

Where it is desired to treat predetermined parts (such as parts 37 and 58) of the objects 28 and 48, the first and second fixtures 16, 42 may be moved so that the predetermined parts 37, 58 face the first and second guides 18, 46 respectively. Then, the first and second guides 18, 46 may be moved so that the first and second guides 18, 46 are oriented towards the predetermined parts 37, 58 respectively, and so that abrasive media 20, 50 is directed towards the predetermined parts 37, 58 by the first and second guides 18, 46 respectively.

In other examples, the first and second guides 18, 46 may first be moved, and then the first and second fixtures 16, 42 may be moved. Consequently, the vibratory finishing apparatus 101 may advantageously enable a plurality of objects to be treated simultaneously and thereby enable the treatment of a greater number of objects within a given time period.

It should be appreciated that in other examples, a vibratory finishing apparatus may comprise any number of dividers, fixtures and guides for treating any number of objects within a receptacle.

Figure 4:
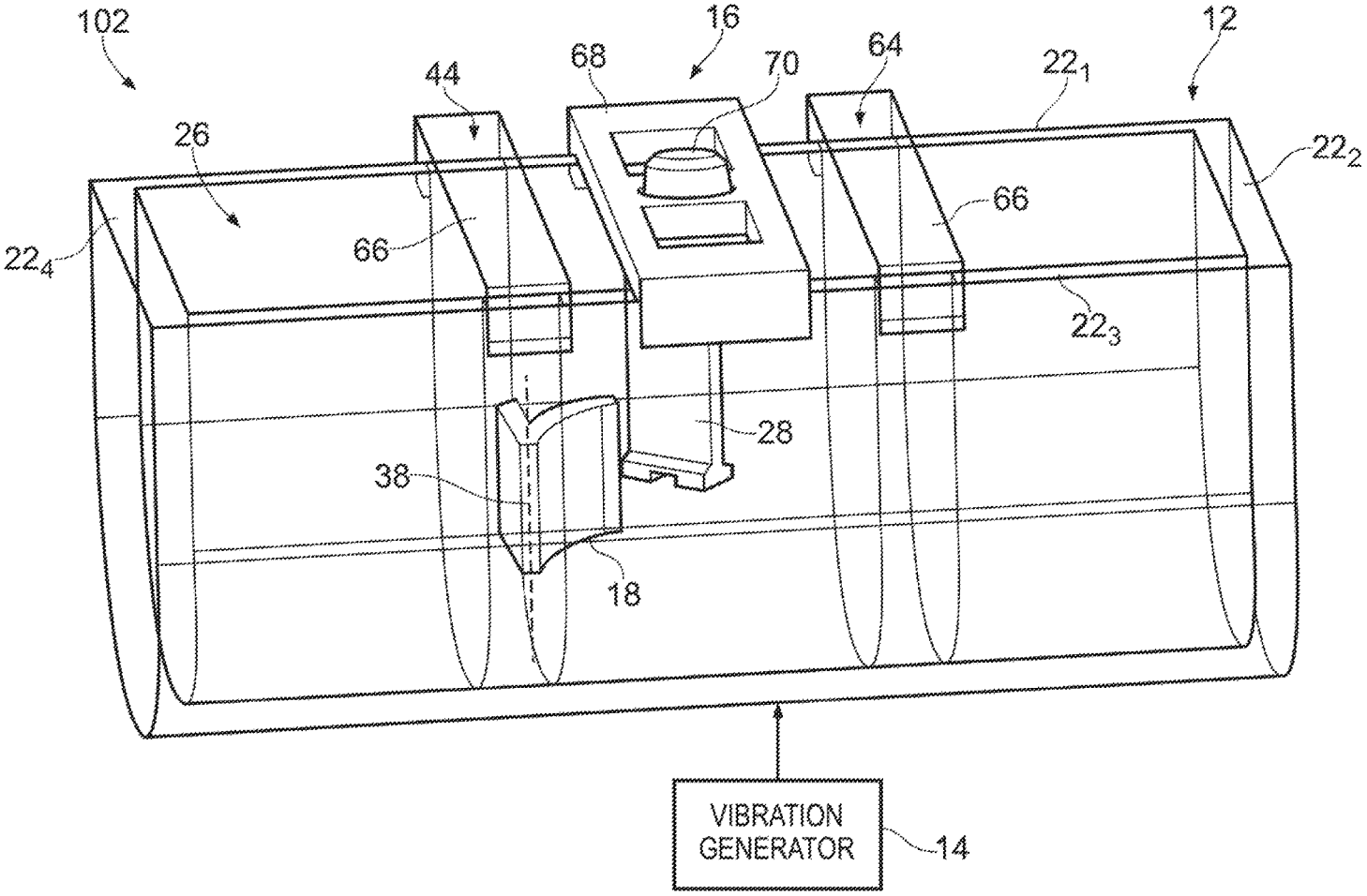
FIG. 4 illustrates a perspective view of a further vibratory finishing apparatus according to various examples.

FIG. 4 illustrates a perspective view of a further vibratory finishing apparatus 102 according to various examples. The vibratory finishing apparatus 102 is similar to the vibratory finishing apparatus 10 and 101 and where the features are similar, the same reference numerals are used.

In this example, the receptacle 12 has a trough shape with a first side wall $\mathbf{22}_1$, a second side wall $\mathbf{22}_2$, a third side wall $\mathbf{22}_3$ and a fourth side wall $\mathbf{22}_4$. The first and third side walls $\mathbf{22}_1$, $\mathbf{22}_3$ are opposite one another and the second and fourth side walls $\mathbf{22}_2$, $\mathbf{22}_4$ are opposite one another. The first and third side walls $\mathbf{22}_1$, $\mathbf{22}_3$ are longer than the second and fourth side walls $\mathbf{22}_2$, $\mathbf{22}_4$ (which are opposite one another).

The vibratory finishing apparatus 102 differs from the vibratory finishing apparatus 101 in that the vibratory finishing apparatus 102 includes a first divider 44 and a second divider 64 positioned within the cavity 26 of the receptacle 12. The fixture 16 is positioned between the first divider 44 and the second divider 64 so that the object 28 is located between the first and second dividers 44, 64 and the first and third side walls $\mathbf{22}_1$, $\mathbf{22}_3$. The guide 18 is coupled to the first divider 44 and may extend towards the fixture 16 and the object 28.

The first divider 44 includes a U shaped frame 66 that is arranged to extend across the first and third side walls $\mathbf{22}_1$, $\mathbf{22}_3$ to support the first divider 44 in the receptacle 12. Similarly, the second divider 44 includes a U shaped frame 66 that is arranged to extend across the first and third side walls $\mathbf{22}_1$, $\mathbf{22}_3$ to support the second divider 64 in the receptacle 12. The U shaped frames 66 of the first and second dividers 44, 64 may be fastened to the first and third side walls $22_1$, $22_3$ of the receptacle 12 via one or more fasteners (such as one or more screws, bolts and so on).

The fixture 16 includes a U shaped frame 68 that is arranged to extend across the first and third side walls $22_1$, $22_3$ to support the fixture 16 in the receptacle 12. The U shaped frame 68 of the fixture 16 may be fastened to the first and third side walls $22_1$, $22_3$ of the receptacle 12 via one or more fasteners (such as one or more screws, bolts and so on). The fixture 16 may also include a handle 70 for enabling a user to rotate the fixture 16 in the first direction 30.

Figure 5:
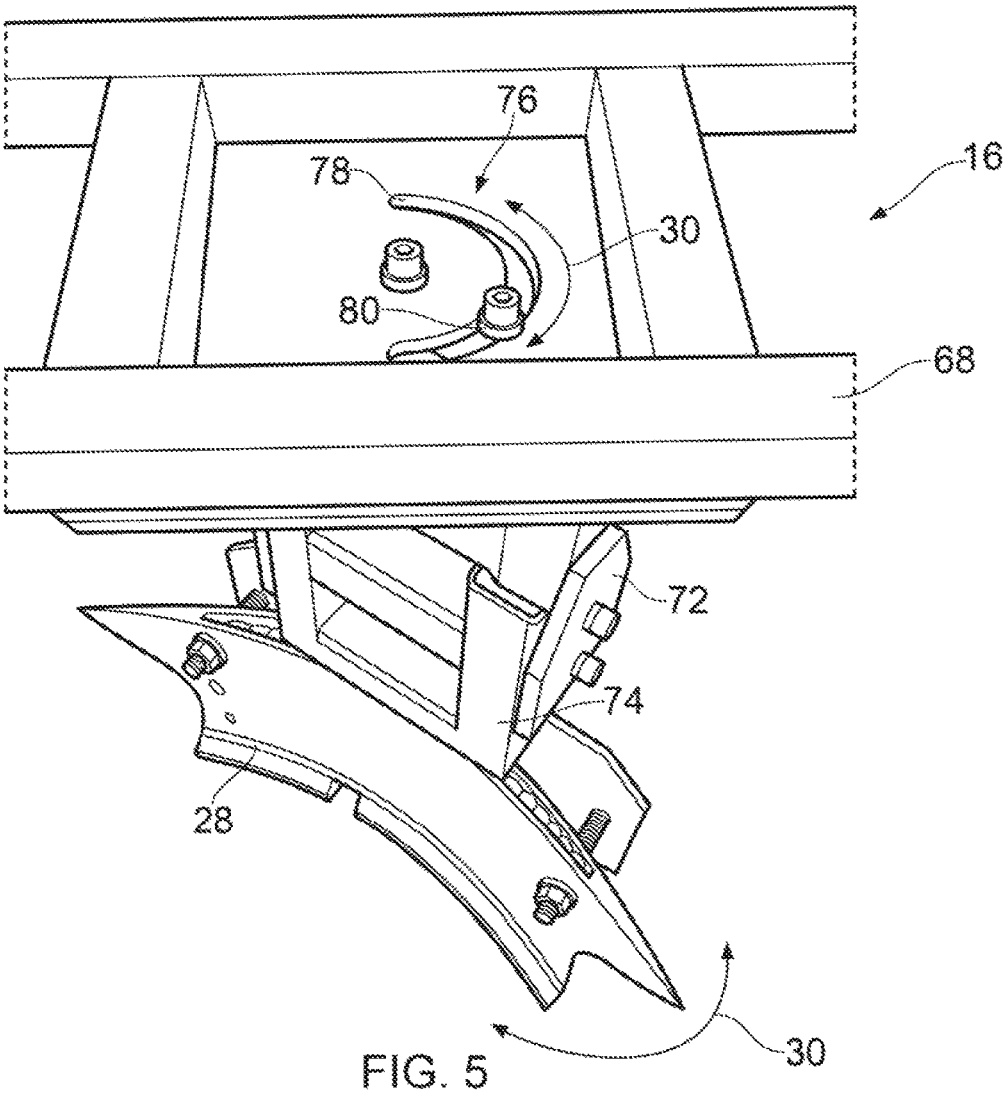
FIG. 5 illustrates a perspective view of the fixture of the vibratory finishing apparatus illustrated in FIG. 4.

FIG. 5 illustrates a perspective view of the fixture 16 of the vibratory finishing apparatus 102 illustrated in FIG. 4. The fixture 16 includes a first part 72 and a second part 74. The first part 72 is coupled to the frame 68 via a joint 76 that enables the first part 72 to rotate relative to the frame 68 in the first direction 30. In this example, the joint 76 includes a U shaped channel 78 defined in the frame 68, and a bolt and nut arrangement 80 that extend from the first part 72 and through the channel 78 and are arranged to move within the channel 78 to enable the first part 72 to roll relative to the frame 68. It should be appreciated that the handle 70 has been removed from the fixture 16 illustrated in FIG. 5 in order to enable the bolt and nut arrangement 80 to be viewed.

Figure 6:
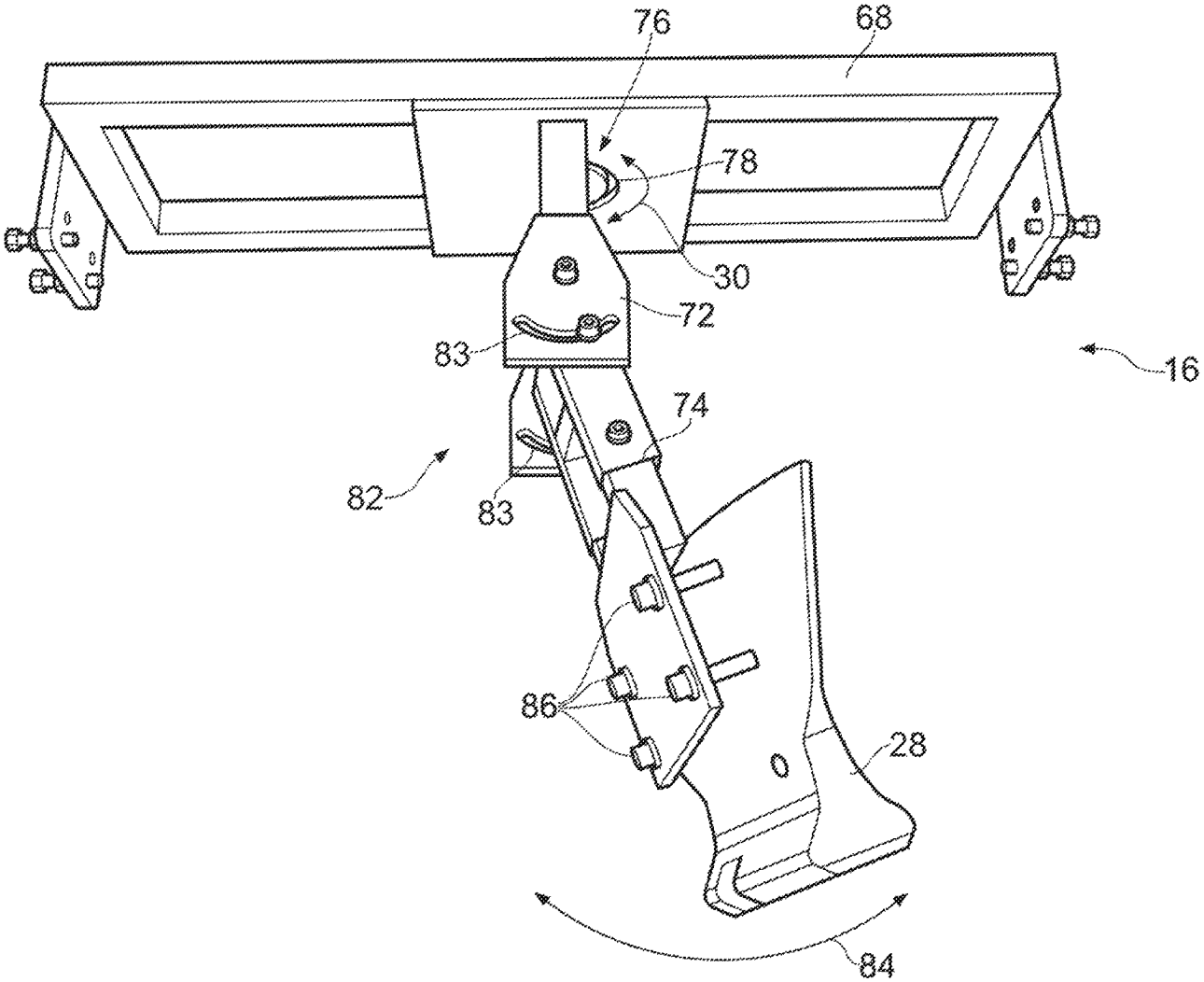
FIG. 6 illustrates another perspective view of the fixture illustrated in FIGS. 4 and 5.

FIG. 6 illustrates another perspective view of the fixture 16 illustrated in FIGS. 4 and 5. The first part 72 and the second part 74 are coupled to one another via a joint 82 that enables the second part 74 to rotate relative to the first part 72 in a second direction, different to the first direction 30 (indicated by arrow 84). The joint 82 includes two channels 83 and a nut and bolt arrangement that extends through the two channels 83 and is moveable within the two channels 83.

The object 28 is coupled to the second part 74 via a nut and bolt arrangement 86. Movement of the second part 74 relative to the first part 72 in the second direction 84 changes the pitch of the second part 74 (and therefore the object 28) relative to the first part 72. Consequently, the joint 76 may be considered to enable the fixture 16 to roll, and the joint 82 may be considered to enable the fixture 16 to pitch. In other words, where the point of coupling between the first part 72 and the frame 68 is considered to be the centre of a spherical coordinate system, the first direction 30 is the azimuthal direction and the second direction 84 is the polar direction.

Figure 7:
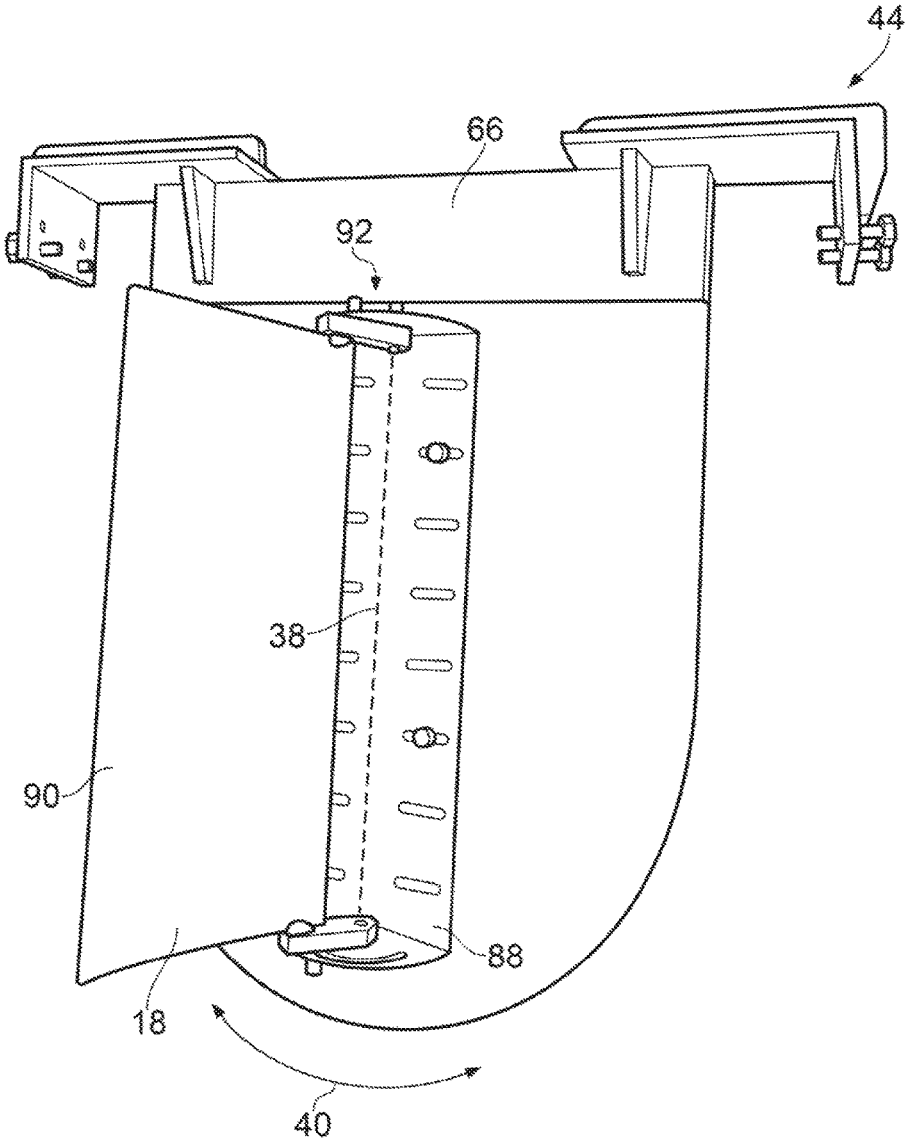
FIG. 7 illustrates a perspective view of the divider and the guide of the vibratory finishing apparatus illustrated in FIG. 4.

FIG. 7 illustrates a perspective view of the divider 44 and the guide 18 of the vibratory finishing apparatus 102 illustrated in FIG. 4. The guide 18 includes a frame 88 that is coupled to the divider 44 (for example, via a plurality of screws) and a guider 90 that is coupled to the frame 88 at a joint 92 that enables the guider 90 to rotate in the direction 40 relative to the frame 88. The guider 90 includes a plate for directing the flow of abrasive media within the receptacle 12. The plate of the guider 90 may be planar or non-planar (for example, the plate of the guider 90 may have a curved profile). The joint 92 may be formed by two channels in the frame 88 and nut, and bolt arrangements extending from the guider 90 that are moveable within the two channels.

The vibratory finishing apparatus 102 illustrated in FIGS. 4 to 7 may provide several advantages. First, the use of the first divider 44 and the second divider 64 may enable the quantity of abrasive media used to treat the object 28 to be reduced (since the volume defined between the first and second dividers 44, 64 is less than the volume defined by the receptacle 12, or the volume between a single divider and the receptacle 12). Second, the ability to rotate the fixture 16 in two different directions 30, 84 and rotate the guide 18 in one direction 40 may enable abrasive media within the receptacle 12 to access parts of the object 28 that are challenging or impossible to access using conventional techniques such as shot peening.

Figure 8:
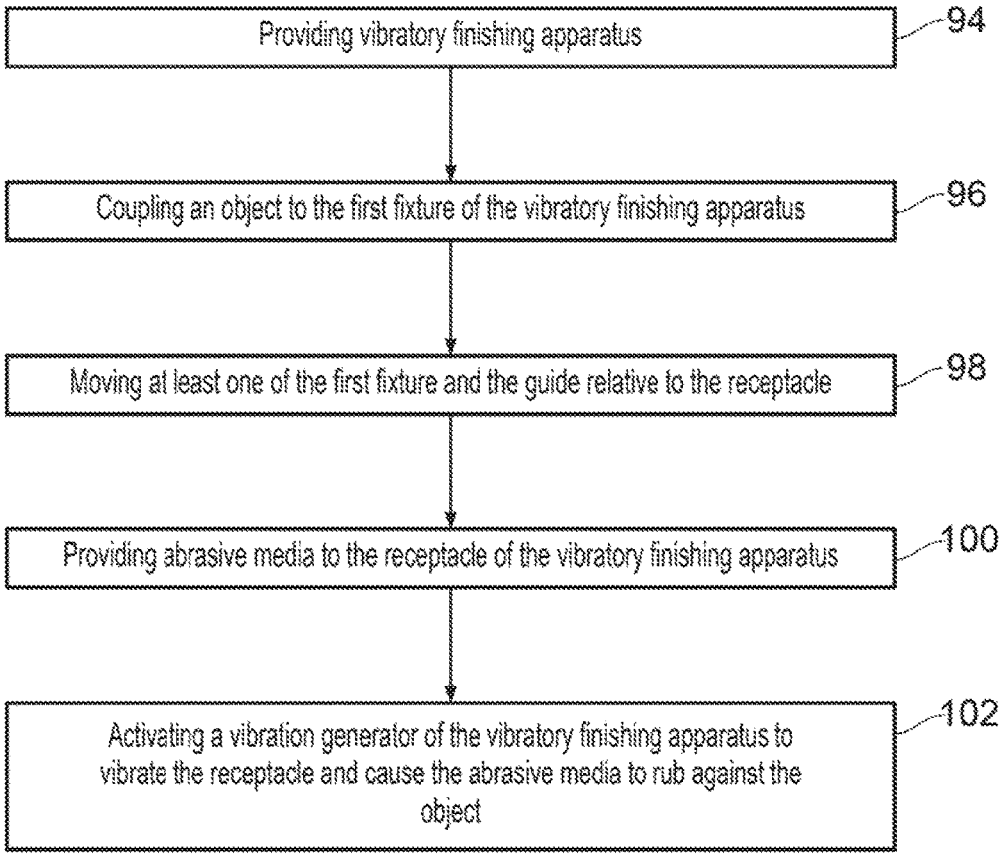
FIG. 8 illustrates a flow diagram of a method of treating an object according to various examples.

FIG. 8 illustrates a flow diagram of a method of treating an object according to various examples.

At block 94, the method includes providing vibratory finishing apparatus 10, 101, 102.

At block 96, the method includes coupling an object 28 to the first fixture 16 of the vibratory finishing apparatus 10, 101, 102. Where the vibratory finishing apparatus 10, 101, 102 includes a plurality of fixtures, the method may include coupling a plurality of objects to the plurality of fixtures.

At block 98, the method includes moving at least one of the first fixture 16 and the first guide 18 relative to the receptacle 12.

At block 100, the method includes providing abrasive media 20 to the receptacle 12 of the vibratory finishing apparatus 10, 10, 102 (that is, the abrasive media 20 is poured into the cavity 26 defined by the receptacle 12).

At block 102, the method includes activating the vibration generator 14 of the vibratory finishing apparatus 10, 101, 102 to vibrate the receptacle 12 and cause the abrasive media 20 to rub against the object 28.

It should be appreciated that the blocks 94, 96, 98, 100, 102 may be performed in a different order to that illustrated in FIG. 8. For example, block 98 may be performed prior to block 96. In other examples, block 98 may be performed prior to, and subsequent to, block 96.

It will be understood that the disclosure is not limited to the embodiments above-described and various modifications and improvements can be made without departing from the concepts described herein.

Except where mutually exclusive, any of the features may be employed separately or in combination with any other features and the disclosure extends to and includes all combinations and sub-combinations of one or more features described herein.

What is claimed is:

1. Vibratory finishing apparatus comprising:

a receptacle to receive abrasive media that is moved or vibrated within the receptacle, the receptacle including a sidewall;

a first fixture to support an object within the receptacle and move the object relative to the receptacle in at least a first direction; and a first guide positioned in the receptacle and connected to the sidewall, the first guide being pivotable, relative to the receptacle to rotate between static orientations, about an axis that extends in a vertical direction along the sidewall when the vibratory apparatus is in use, the first guide configured to direct the media moved within the receptacle toward a predetermined part of the object while the first guide is being held in one of the static orientations.

2. Vibratory finishing apparatus as claimed in claim 1, wherein the first fixture is arranged to move the object relative to the receptacle in at least the first direction by rotating the object.

3. Vibratory finishing apparatus as claimed in claim 1, wherein the first fixture is arranged to move the object relative to the receptacle in a second direction, different to the first direction.

4. Vibratory finishing apparatus as claimed in claim 3, wherein the first fixture is arranged to move the object relative to the receptacle in the second direction by rotating the object.

5. Vibratory finishing apparatus as claimed in claim 1, wherein the first fixture comprises a first fastener to fasten the first fixture to the receptacle.

6. Vibratory finishing apparatus as claimed in claim 1, wherein the first fixture comprises a second fastener to fasten the object to the first fixture.

7. Vibratory finishing apparatus as claimed in claim 1, further comprising a first divider separate from and insertable into the receptacle and configured to be positioned within the receptacle, extending across the receptacle and abutting the receptacle at each end of the first divider to separate the abrasive media received in the receptacle.

8. Vibratory finishing apparatus as claimed in claim 7, wherein the first divider comprises a fastener to fasten the first divider to the receptacle.

9. Vibratory finishing apparatus as claimed in claim 1, further comprising:

a second fixture to support a further object within the receptacle and move the further object relative to the receptacle in at least a second direction; and a second guide movable between static orientations, the second guide configured to direct the media moved within the receptacle toward a predetermined part of the further object while the second guide is being held in one of the static orientations.

10. Vibratory finishing apparatus as claimed in claim 1, wherein the object comprises a fan blade root, or a nozzle guide vane, or a component manufactured by three dimensional additive manufacturing.

11. A method of treating an object, the method comprising:

providing vibratory finishing apparatus as claimed in claim 1;

coupling an object to the first fixture of the vibratory finishing apparatus;

moving at least one of the first fixture and the first guide relative to the receptacle;

providing abrasive media to the receptacle of the vibratory finishing apparatus; and activating a vibration generator of the vibratory finishing apparatus to vibrate the receptacle and cause the abrasive media to rub against the object.

12. The vibratory finishing apparatus as claimed in claim 1, wherein the axis is adjacent to an end of the first guide at a joint that connects a side of the first guide to the side wall.

13. The vibratory finishing apparatus as claimed in claim 1, wherein the first guide includes:

a frame secured to and extending along the sidewall;

a guider plate to direct the media moved within the receptacle toward a predetermined part of the object; and a joint connecting a side of the guider plate to the frame, the joint configured such that the guider plate is rotatable about an axis at the joint, the axis extending along the frame.

14. Vibratory finishing apparatus comprising:

a receptacle to receive abrasive media;

a divider configured to be positioned within the receptacle, the divider extending across the receptacle and abutting the receptacle at each end of the divider;

a first fixture to support an object within a portion of the receptacle defined in part by the divider and move the object relative to the receptacle in at least a first direction; and a first guide positioned in the portion of the receptacle and is connected at least to the divider and is arranged to rotate relative to the divider about an axis that extends in a vertical direction along the divider when the vibratory apparatus is in use, the first guide being movable relative to the receptacle between static orientations, the first guide configured to direct the media moved within the receptacle toward a predetermined part of the object while the first guide is being held in one of the static orientations.

15. The vibratory finishing apparatus as claimed in claim 14, wherein the divider includes a u-shaped frame configured to support the weight of a body of the divider and to fasten the divider to the receptacle.

16. The vibratory finishing apparatus as claimed in claim 14, wherein the first guide includes:

a frame secured to and extending along the divider;

a guider plate to direct the media moved within the receptacle toward a predetermined part of the object; and a joint connecting a side of the guider plate to the frame, the joint configured such that the guider plate is rotatable about an axis at the joint, the axis extending along the frame.

17. The vibratory finishing apparatus as claimed in claim 14, wherein the divider is separate from and insertable into the receptacle and the divider is configured to separate the abrasive media received in the receptacle.

* * * * *